US006817303B2

(12) United States Patent
Gosselin

(10) Patent No.: US 6,817,303 B2
(45) Date of Patent: Nov. 16, 2004

(54) FOLDING TABLE BASE

(75) Inventor: James P. Gosselin, 17 Woodland Hills Rd., Batavia, IL (US) 60510

(73) Assignee: James P. Gosselin, Batavia, IL (US)

( * ) Notice: Subject to any disclaimer, the term of this patent is extended or adjusted under 35 U.S.C. 154(b) by 0 days.

(21) Appl. No.: 10/346,452

(22) Filed: Jan. 17, 2003

(65) Prior Publication Data

US 2003/0164122 A1 Sep. 4, 2003

Related U.S. Application Data

(60) Division of application No. 09/792,709, filed on Feb. 23, 2001, now Pat. No. 6,550,405, which is a continuation-in-part of application No. 09/607,233, filed on Jun. 30, 2000, now abandoned, which is a continuation-in-part of application No. 09/258,721, filed on Feb. 26, 1999, now Pat. No. 6,082,271.

(51) Int. Cl.[7] ..... A47B 3/00

(52) U.S. Cl. ..... 108/131; 108/115; 108/133; 108/132

(58) Field of Search ..... 108/143, 137, 108/50.01; 248/188.8, 188.9, 188.1

(56) References Cited

U.S. PATENT DOCUMENTS

| | | | | |
|---|---|---|---|---|
| 240,301 A | | 4/1881 | Buss | |
| 422,639 A | | 3/1890 | Schwencke | |
| 911,611 A | * | 2/1909 | Rendall | 248/188.8 |
| 1,708,214 A | | 4/1929 | Burris | |
| 2,531,259 A | | 11/1950 | Cudini | |
| 2,695,827 A | | 11/1954 | De Saussure, Jr. | 108/133 |
| 2,860,940 A | | 11/1958 | Saussure | 311/88 |
| 3,261,584 A | | 7/1966 | Miller | 248/188.2 |
| 3,527,436 A | | 9/1970 | Stone et al. | 248/188.4 |
| 3,596,945 A | | 8/1971 | Mulvin | 287/99 |
| 3,701,506 A | | 10/1972 | Favreau | 248/188.5 |
| 3,704,850 A | | 12/1972 | Hendrickson et al. | 248/188.5 |
| 3,796,169 A | * | 3/1974 | Bales et al. | 248/188.8 |
| 3,855,946 A | | 12/1974 | Bales | 108/144 |
| 3,921,539 A | * | 11/1975 | Berger | 248/188.8 |
| 3,960,352 A | * | 6/1976 | Plattner et al. | 248/188 |
| 4,052,100 A | | 10/1977 | Nikitits et al. | 297/159 |
| 4,079,965 A | | 3/1978 | Moughty et al. | 285/7 |
| 4,190,377 A | | 2/1980 | Pleuss | 403/108 |
| 4,317,387 A | | 3/1982 | Myers et al. | 74/493 |
| 4,318,353 A | | 3/1982 | Schier | 108/132 |
| 4,494,465 A | | 1/1985 | Fick, Jr. | 108/44 |
| 4,838,181 A | * | 6/1989 | Luyk | 248/188 |
| 4,909,159 A | | 3/1990 | Gonsoulin | 108/44 |
| 4,995,322 A | | 2/1991 | Frederick | 108/44 |
| 5,107,775 A | | 4/1992 | Langlais et al. | 108/144 |
| 5,109,778 A | | 5/1992 | Berkowitz et al. | 108/133 X |
| 5,224,429 A | | 7/1993 | Borgman et al. | 108/147 |
| 5,354,027 A | | 10/1994 | Cox | 248/291 |
| 5,427,035 A | | 6/1995 | Grahl | 108/144 |

(List continued on next page.)

FOREIGN PATENT DOCUMENTS

JP 60-69343 * 4/1985

*Primary Examiner*—Jose V. Chen
(74) *Attorney, Agent, or Firm*—Jenkens & Gilchrist

(57) ABSTRACT

A folding table base is provided which includes a mounting plate adapted to be secured to the bottom of a table. A hinge plate is hingedly connected to the side of the mounting plate. The hinge plate is adapted to pivot between a first position and a second position. A leg is secured to the hinge plate and extends generally orthogonal thereto. A latching mechanism is secured to the bottom of the table. The latching mechanism includes a latch mounting plate and a pull latch. The pull latch being slidably mounted on the latch mounting plate such that the pull latch is operable between a latched position and an unlatched position. The latching mechanism engages the hinge plate when the pull latch is in the latched position and disengages the hinge plate when the pull latch is in the unlatched position.

15 Claims, 21 Drawing Sheets

U.S. PATENT DOCUMENTS

| | | | | |
|---|---|---|---|---|
| 5,490,467 | A | | 2/1996 | Diffrient ..... 108/133 X |
| 5,494,333 | A | | 2/1996 | Wilson ..... 297/344.18 |
| 5,562,052 | A | | 10/1996 | Glashouwer et al. |
| 5,673,633 | A | | 10/1997 | Pfister |
| 5,676,483 | A | | 10/1997 | Koubek |
| 5,685,237 | A | * | 11/1997 | Lehrman ..... 248/188.8 |
| 5,755,164 | A | | 5/1998 | Korte et al. |
| 5,769,005 | A | | 6/1998 | Haynes |
| 5,813,272 | A | | 9/1998 | Gomi |
| 5,845,589 | A | | 12/1998 | Pfister |
| 5,873,312 | A | | 2/1999 | Mauro-Vetter |
| 5,918,553 | A | | 7/1999 | Hellwig et al. |
| 5,934,630 | A | | 8/1999 | Williams et al. |
| 5,941,181 | A | | 8/1999 | Hornberger et al. |
| 6,029,587 | A | | 2/2000 | Rozier, Jr. et al. |
| 6,082,271 | A | | 7/2000 | Gosselin et al. |
| 6,109,191 | A | | 8/2000 | Schworer |
| 6,112,748 | A | | 9/2000 | Esdale et al. |
| 6,189,843 | B1 | | 2/2001 | Pfister |
| 6,347,777 | B1 | | 2/2002 | Webber et al. |

* cited by examiner 77
76
62
62a
60a
75
74
60
62

77
62a
76
62a
62a
62a
62
75
74
60
62

62
77
77
75
74
74
76
60
62

FOLDING TABLE BASE

CROSS-REFERENCE TO RELATED APPLICATION

This application is a divisional of U.S. patent application Ser. No. 09/792,709, filed Feb. 23, 2001, now U.S. Pat. No. 6,550,405 which is a continuation-in-part of U.S. patent application Ser. No. 09/607,233 filed Jun. 30, 2000 for "A Folding Table Base," now abandoned, which in turn is a continuation-in-part of U.S. patent application Ser. No. 09/258,721 filed Feb. 26, 1999, for "A Folding Table Base," now U.S. Pat. No. 6,082,271.

FIELD OF THE INVENTION

This invention relates generally to folding tables, and in particular to a folding table base for easily folding and unfolding table legs that latch open.

BACKGROUND OF THE INVENTION

Tables and chairs are supported by legs that extend from a base. Some table and/or chairs include foldable legs. Folding legs take up less room and facilitate storage of the table or chair when it is not being used. Prior folding tables include a base having two foldable arms extending therefrom. The arms include a pair of legs extending from each of the arms. Each arm is foldable between a horizontal (closed) position and a vertical (open) position. These arms are traditionally locked into a vertical position by folding braces that include two members joined by a pivot point. These braces extend between the bottom of the table and each arm. When the arms are in the vertical position, the braces are straight and form an angle with respect to the bottom of the table. Generally this angle is about 45 degrees. The legs of the table are locked into the vertical position by sliding a collar down over each folding brace such that the two members can not pivot with respect to each other. To close the legs of this prior table, the collar is moved upward so each brace can bend at the pivot point approximately 90 degrees, thus allowing each arm to fold from the vertical position to the horizontal position. These types of folding tables are awkward to fold and unfold and often require more than one person to manipulate. In addition, these prior folding tables are prone to pinching fingers during set-up and take-down. Many prior folding tables are also wobbly, unstable and lack aesthetic appeal.

Therefore, a need exists for a folding table that is sturdy in construction, easy to manipulate and compact when folded to facilitate easy storage.

SUMMARY OF THE INVENTION

A folding table base is provided which includes a mounting plate adapted to be secured to the bottom of a table. A hinge plate is hingedly connected to the side of the mounting plate. The hinge plate is adapted to pivot between a first position and a second position. A leg is secured to the hinge plate and extends generally orthogonal thereto. A latching mechanism is secured to the bottom of the table. The latching mechanism includes a latch mounting plate and a pull latch. The pull latch being slidably mounted on the latch mounting plate such that the pull latch is operable between a latched position and an unlatched position. The latching mechanism engages the hinge plate when the pull latch is in the latched position and disengages the hinge plate when the pull latch is in the unlatched position.

BRIEF DESCRIPTION OF THE DRAWINGS

Other objects and advantages of the invention will become apparent upon reading the following detailed description and upon reference to the drawings in which.

Figure 1:
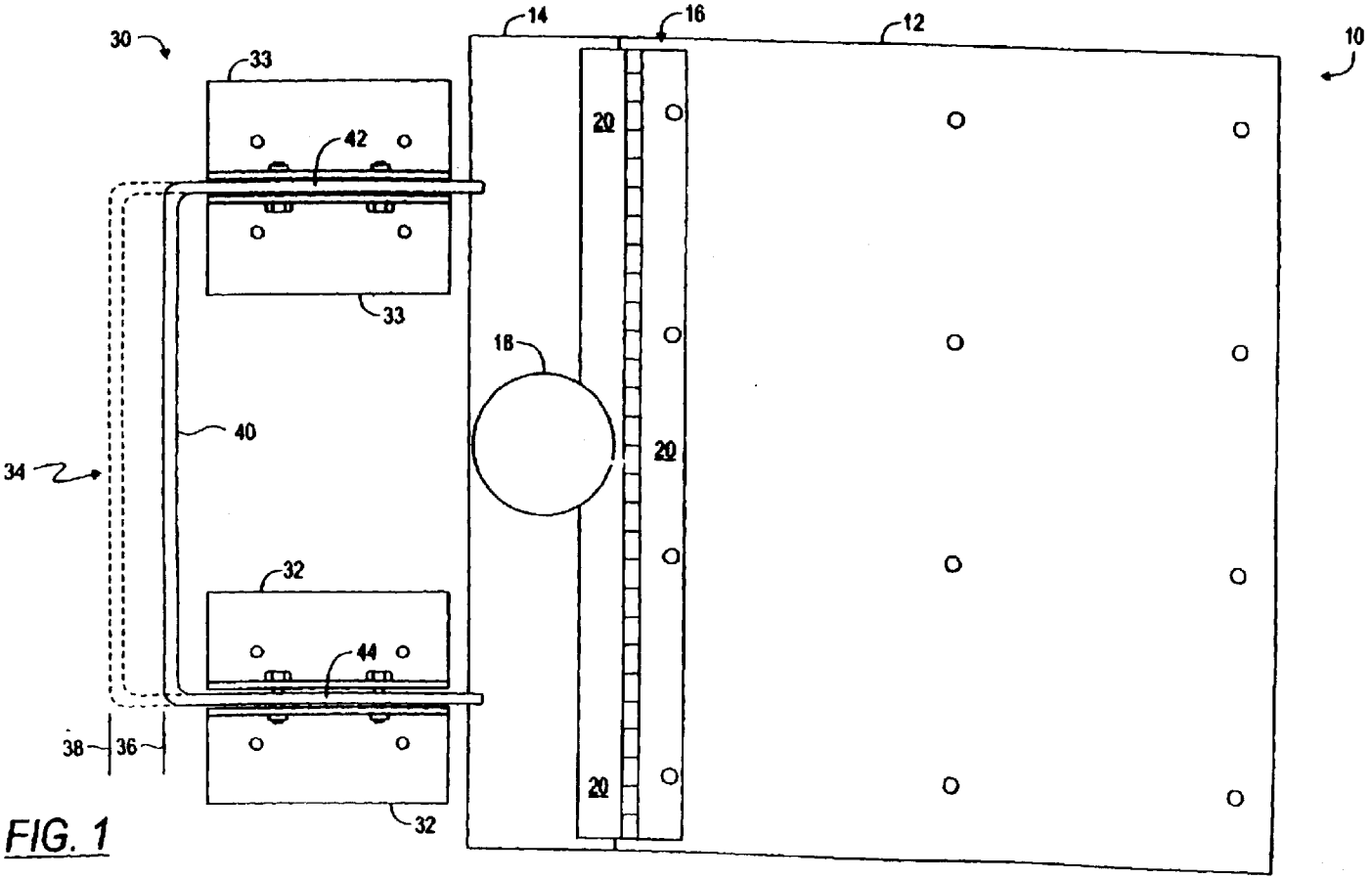
FIG. 1 is a top view of a folding table base according to the present invention in the open position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Figure 12A:
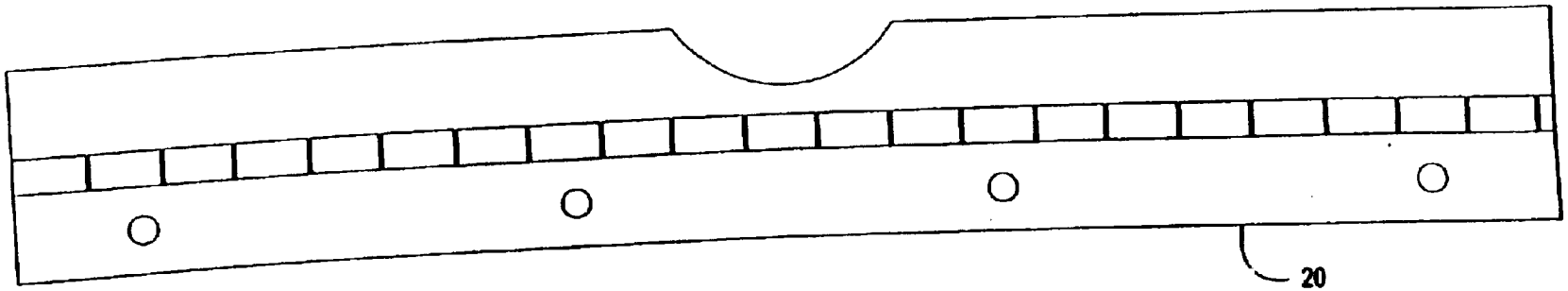
FIG. 12*a* is a top view of a hinge for use with the folding table base of FIG. 1.
Figure 12B:
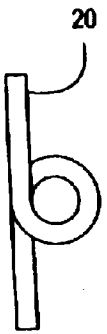
FIG. 12*b* is a end view of the hinge of FIG. 12*a;*

Referring to FIG. 1, there is shown a folding table base 10. The base 10 includes a mounting plate 12 and a hinge plate 14. The mounting plate 12 is adapted to be secured to the bottom of a table (such as the table 13 shown in FIG. 13*a*) by fasteners such as nails, screws, bolts, etc. The hinge plate 14 is pivotally connected to a side 16 of the mounting plate 12 by a hinge 20, best illustrated in FIGS. 12*a* and 12*b*. The hinge 20 is secured to the mounting plate 12 by welding, riveting, fastening, etc. The hinge plate 14 is adapted to pivot between a first position and a second position. Typically, the first position corresponds to a horizontal position or coplanar (in relation to the base plate 12) and the second position corresponds to a vertical position (in relation to the base plate 12). Returning to FIG. 1, a leg 18 is secured to the hinge plate 14 and extends generally orthogonal thereto. The leg 18 can be secured to the hinge plate 14 by welding, riveting, fastening, etc.

Figure 9B:
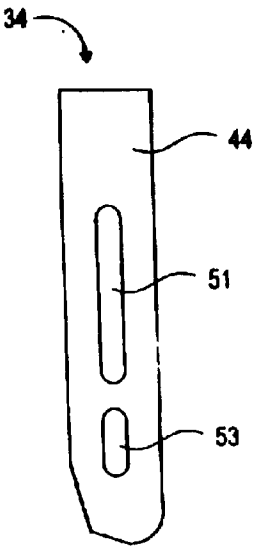
FIG. 9*b* is a end view of the pull latch of FIG. 9*a;*
Figure 9A:
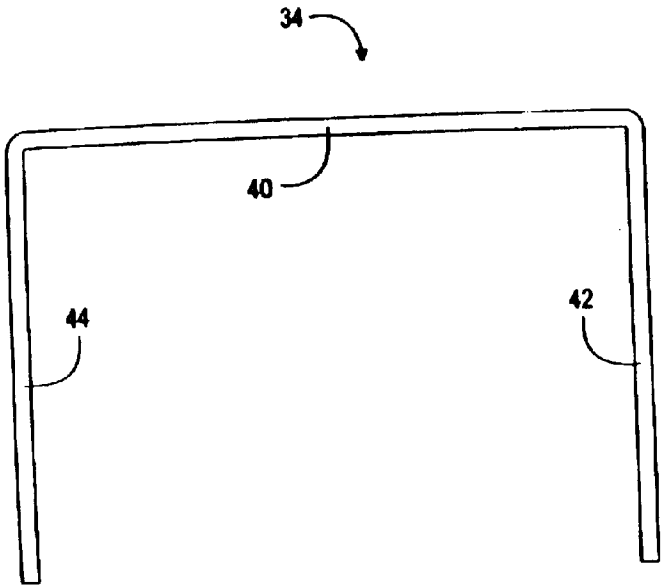
FIG. 9*a* is a top view of a pull latch for use with the latching mechanism of FIG. 4.

A latching mechanism 30 is also secured to the bottom of the table. The latching mechanism 30 can be secured by fasteners such as nails, screws, bolts, etc. The latching mechanism 30 includes latch mounting plates 32 and 33 and a pull latch 34, best illustrated in FIGS. 9*a* and 9*b*. The pull latch 34 being slidably mounted on the latch mounting plates 32 and 33 such that the pull latch 34 is operable between a latched position 36 and an unlatched position 38. (The pull latch 34 is shown in the unlatched position 38 in phantom).

Figure 2:
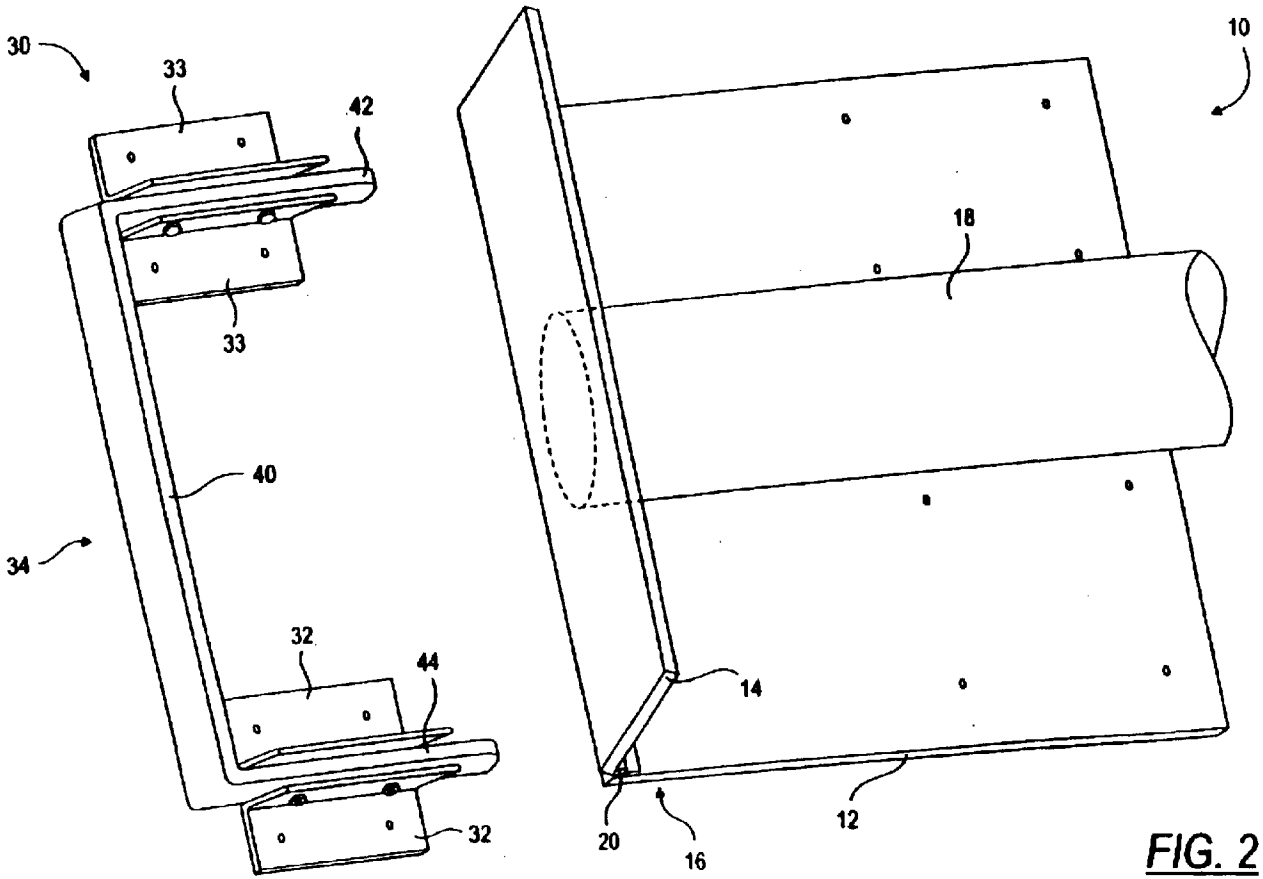
FIG. 2 is a plan view of the folding table base in the closed position.

Referring again to FIG. 1, the pull latch 34 includes a handle portion 40 and two locking members 42 and 44. The locking members 42 and 44 are disposed at respective ends of the handle portion 40 and extend generally orthogonal thereto. The latching mechanism 30 engages the hinge plate 14 when the pull latch 34 is in the latched position and disengages the hinge plate 14 when the pull latch 34 is in the unlatched position. The locking members 42 and 44 of the latching mechanism 30 engage the hinge plate 14 at two displaced locations on the hinge plate. This insures that the hinge plate 14 is securely latched in the horizontal (open) position by the latching mechanism 30. Thus, the leg 18 is securely and stably extended in a vertical (open) position. Pulling the pull latch 34 to the unlatched position 38 disengages the latching mechanism 30 from the hinge plate 14 allowing the leg 18 to be folded from a vertical position, illustrated in FIG. 1, to a horizontal position, illustrated in FIG. 2. At that point, the pull latch 34 can be released which will return the pull latch 34 to the latched position 36, as illustrated in FIG. 2. This allows for easily folding the table into a compact, easy to store unit.

Figure 4:
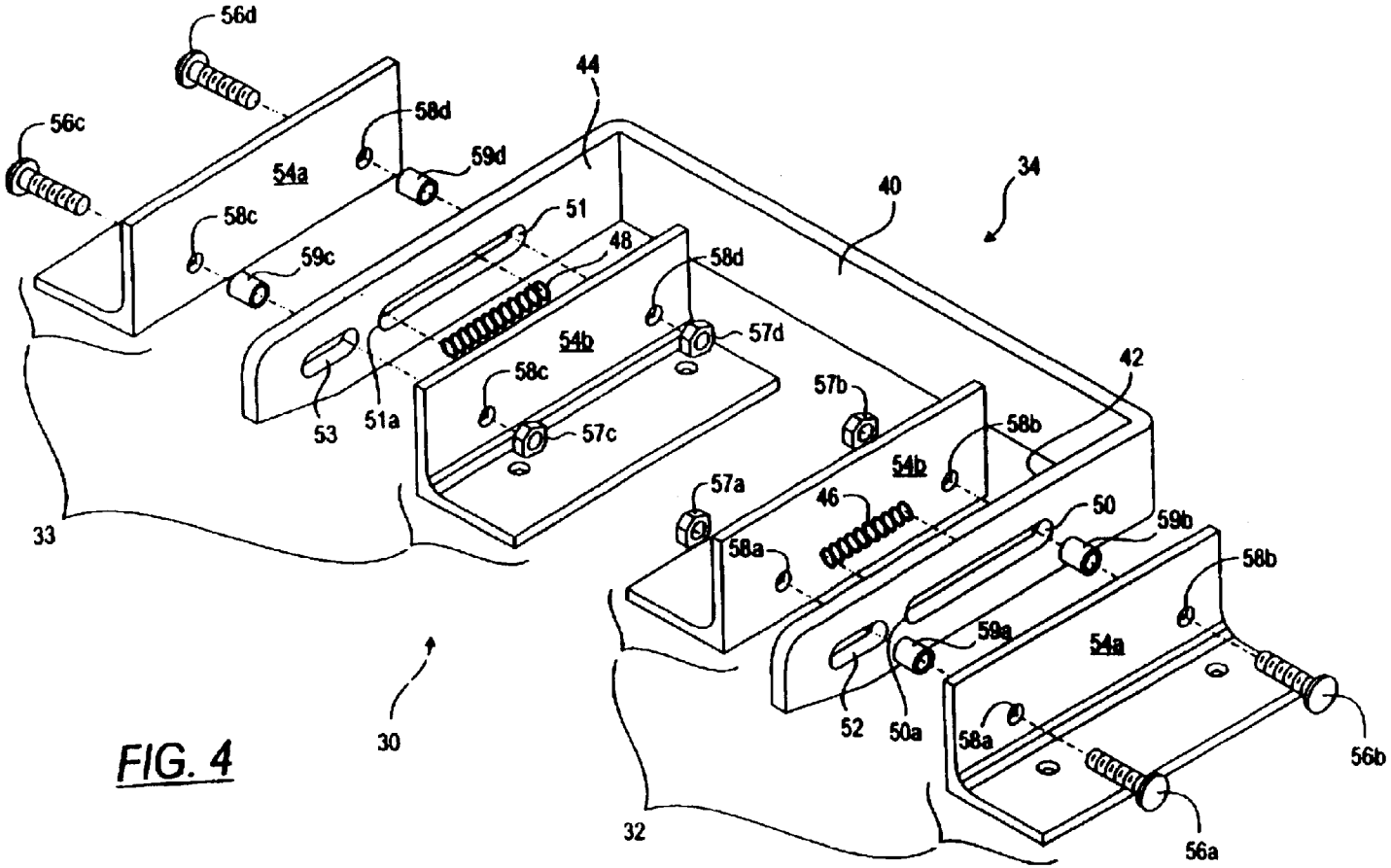
FIG. 4 is an exploded perspective view of a latching mechanism according to the present invention.
Figure 8B:
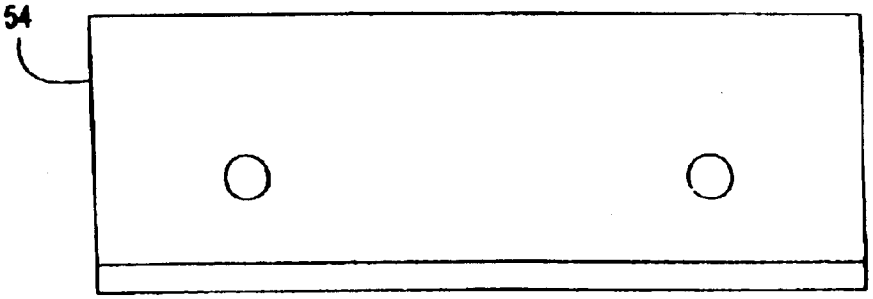
FIG. 8*b* is a front view of the hinge plate of FIG. 8*a;*
Figure 8A:
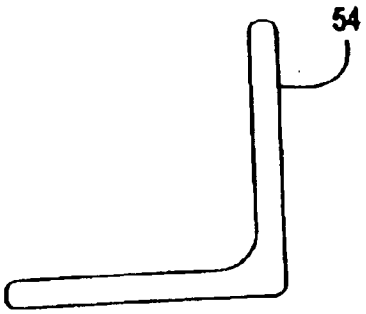
FIG. 8*a* is a side view of a hinge plate for use with the folding table base of FIG. 1.

FIG. 4 illustrates one embodiment where the latch mounting plates 32 and 33 each comprise a pair of angle mounts 54*a* and 54*b*. Each angle mount 54 is identical in construction, as illustrated in FIGS. 8*a* and 8*b*. Each angle mount is secured to the bottom of the table by one or more fasteners (not shown) such as nails, screws, bolts, etc. As illustrated in FIG. 4, the pull latch 34 is slidably mounted between a first pair of angle mounts 54*a*, 54*b* (comprising first latch mounting plate 32) and a second pair of angle mounts 54*a*, 54*b* (comprising second latch mounting plate 33). Fasteners 56*a,b* (e.g., bolts) are inserted through holes 58*a,b* in a first angle mount 54*a* while corresponding fasteners 57*a,b* (e.g., nuts) are secured to the ends of the fasteners 56*a,b* protruding out of the corresponding holes 58*a,b* in a second angle mount 54*b*.

In one embodiment, the pull latch 34 is biased in the latched position by springs 46 and 48. The springs 46 and 48 are located in generally rectangular openings 50 and 51, respectively. The opening 50 and 51 are located in the respective locking members 42 and 44 of the pull latch 34. In this embodiment, a fastener 56*a* is inserted through a hole 58*a* in a first angle mount 54*a* of latch mounting plate 32, and through a sleeve 59*a* disposed in an opening 52. The fastener extends out of the corresponding hole 58*a* in a second angle mount 54*b* and a corresponding fastener 57*a* is secured to the end thereof, as illustrated in FIG. 4. Likewise, a fastener 56*b* is inserted through a hole 58*b* in the first angle mount 54*a* of latch mounting plate 32, and through a sleeve 59*b* disposed in the opening 50. The fastener extends out of the corresponding hole 58*b* in the second angle mount 54*b* and a corresponding fastener 57*b* is secured to the end thereof. Similarly, a fastener 56*c* is inserted through a hole 58*c* in a first angle mount 54*a* of latch mounting plate 33, and through a sleeve 59*c* disposed in an opening 53. The fastener extends out of the corresponding hole 58*c* in a second angle mount 54*b* and a corresponding fastener 57*c* is secured to the end thereof, as illustrated in FIG. 4. Likewise, a fastener 56*d* is inserted through a hole 58*d* in the first angle mount 54*a* of latch mounting plate 33, and through a sleeve 59*d* disposed in the opening 51. The fastener extends out of the corresponding hole 58*d* in the second angle mount 54*b* and a corresponding fastener 57*d* is secured to the end thereof.

The spring 46 is inserted in the generally rectangular opening 50 between the front 50*a* of the opening 50 and the fastener 56*b*. Similarly, the spring 48 is inserted in the generally rectangular opening 51 between the front 51*a* of the opening 51 and the fastener 56*d*. Therefore, when the pull latch 34 is pulled from the latched position 36 to the unlatched position 38, the springs 46 and 48 are compressed between the fronts 50*a*, 51*a* of the openings 50, 51 and the respective bolts 56*b,d*. Releasing the pull latch 34 allows the springs 46, 48 to uncompressed, thus moving the pull latch 34 from the unlatched position 38 to the latched position 36, as illustrated in FIGS. 1, 2 and 4.

Figure 5:
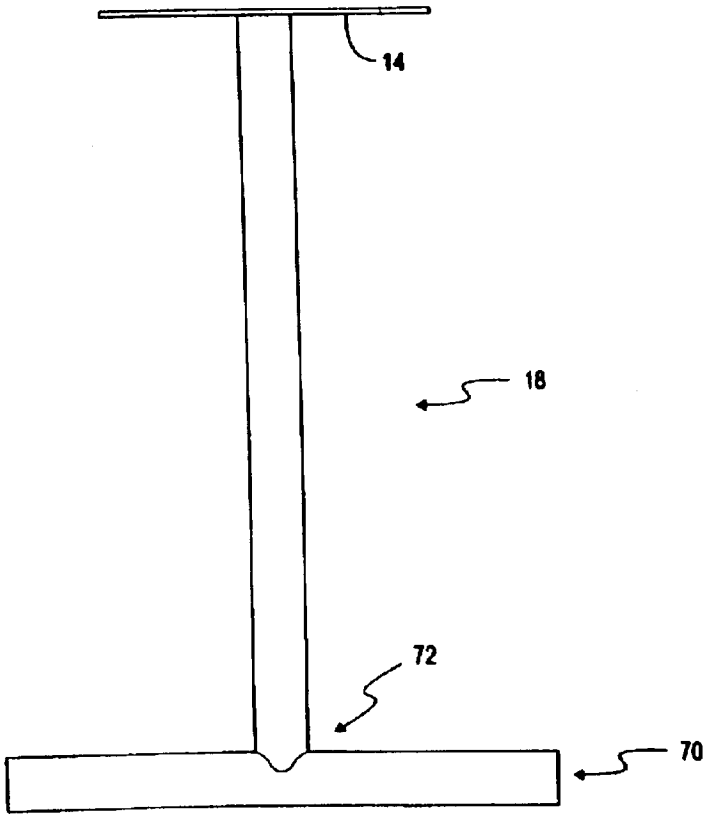
FIG. 5 is a side view of a leg attached to the folding table base of FIG. 1.
Figure 7:
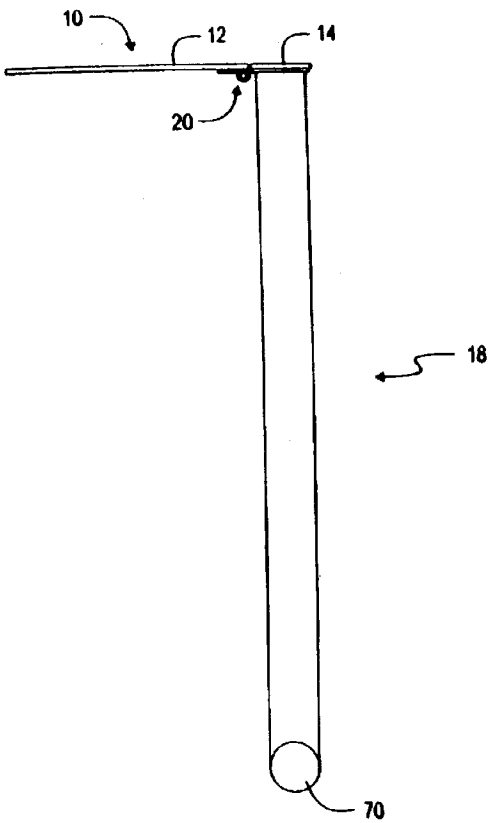
FIG. 7 is a front view of FIG. 5 showing the leg attached to the folding table base.

FIG. 5 illustrates another embodiment where the leg 18 includes a foot 70 secured to a distal end 72 of the leg 18. The foot 70 is generally orthogonal to the leg 18. In one aspect, the foot 70 is tubular, as illustrated in FIG. 5. In another aspect, the foot 70 is a flat plate (not illustrated). FIG. 7 illustrates a front view of the leg 18 and its attachment to the hinge plate 14 of the folding table base 10.

Figure 3:
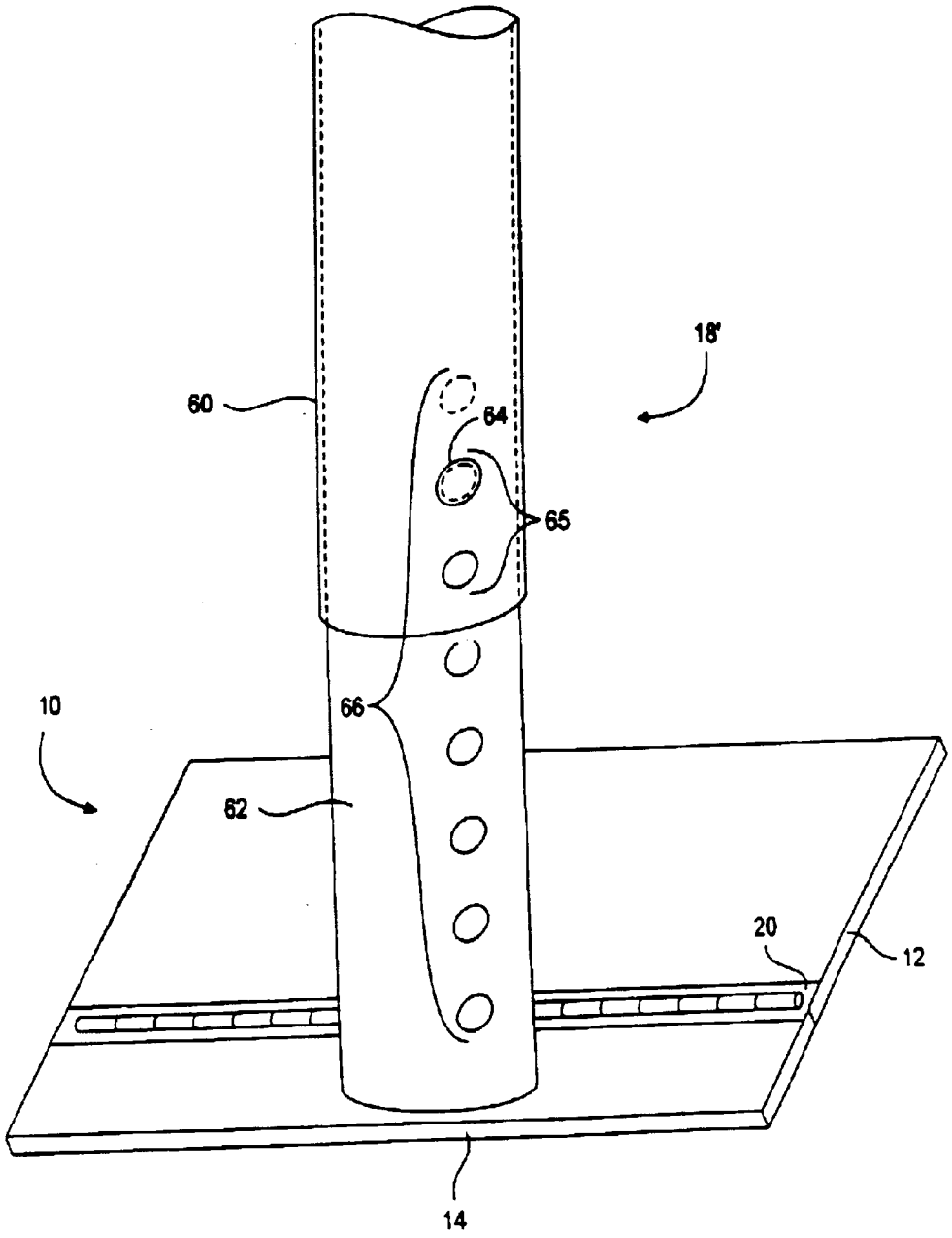
FIG. 3 is a perspective view of an adjustable leg according to the present invention having a first section and a second section.
Figure 6:
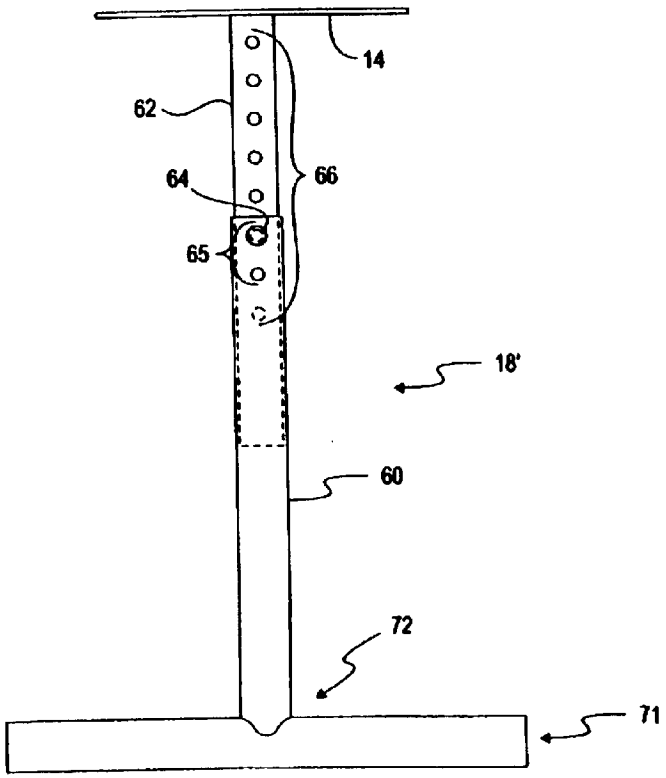
FIG. 6 is a side view of the adjustable leg of FIG. 3 attached to the folding table base of FIG. 1.
Figure 10:
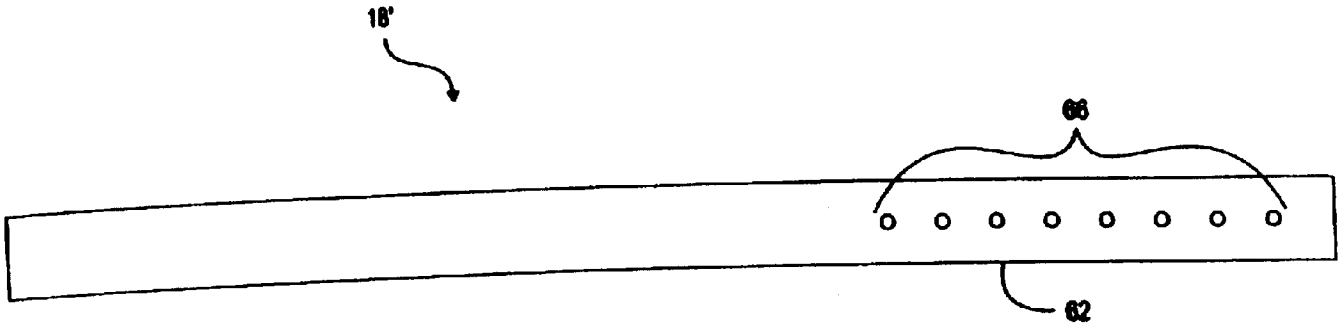
FIG. 10 is a side view of the second section of the adjustable leg of FIG. 3.
Figure 11:
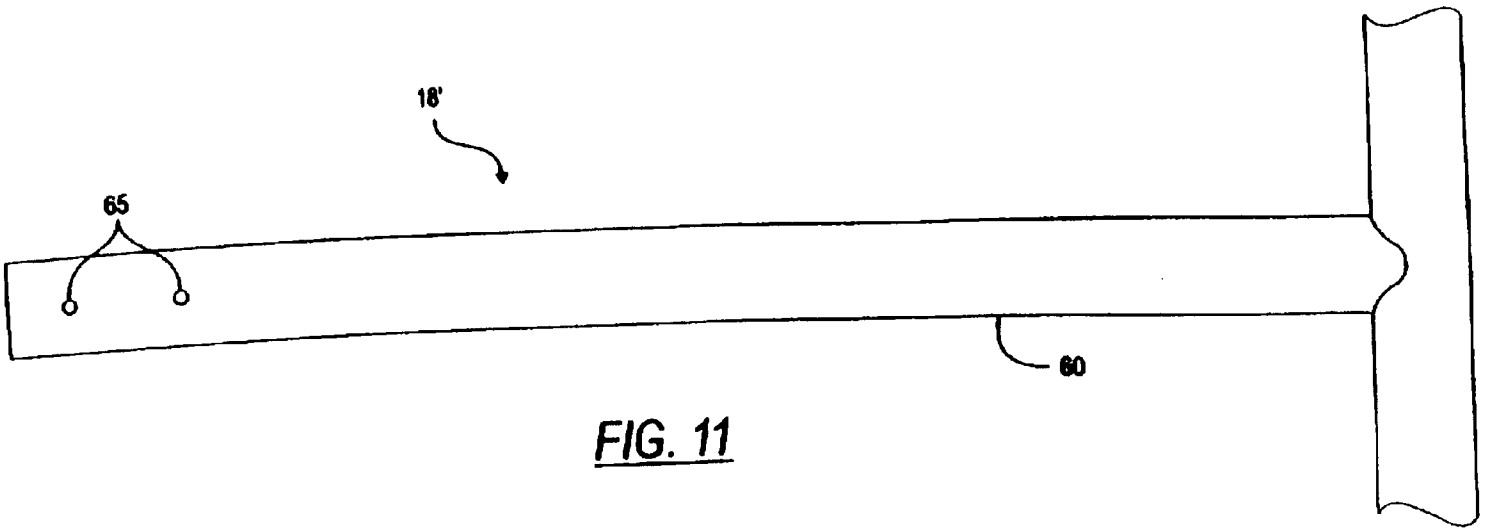
FIG. 11 is a side view of the first section of the adjustable leg of FIG. 3.

FIGS. 3 and 6 illustrate still another embodiment where the leg is telescopically adjustable. In this embodiment, a leg 18' includes a first tubular section 60 and a second tubular section 62 which is slidably disposed within the first tubular section 60. The second tubular section 62 is secured to the hinge plate 14 and extends generally orthogonal thereto. A foot 71 is secured to the distal end 72 of the first tubular section 60. The first tubular section 60 has a plurality of holes 65 disposed therethrough. The second tubular section 62 has a plurality of holes 66 disposed therethrough. The leg 18' is secured in a particular position by a pin 64 inserted through one pair of aligned holes 65 and 66. FIG. 10 illustrates a side view of the second section 62 while FIG. 11 illustrates the first section 60 of the adjustable leg 18'.

Figure 13A:
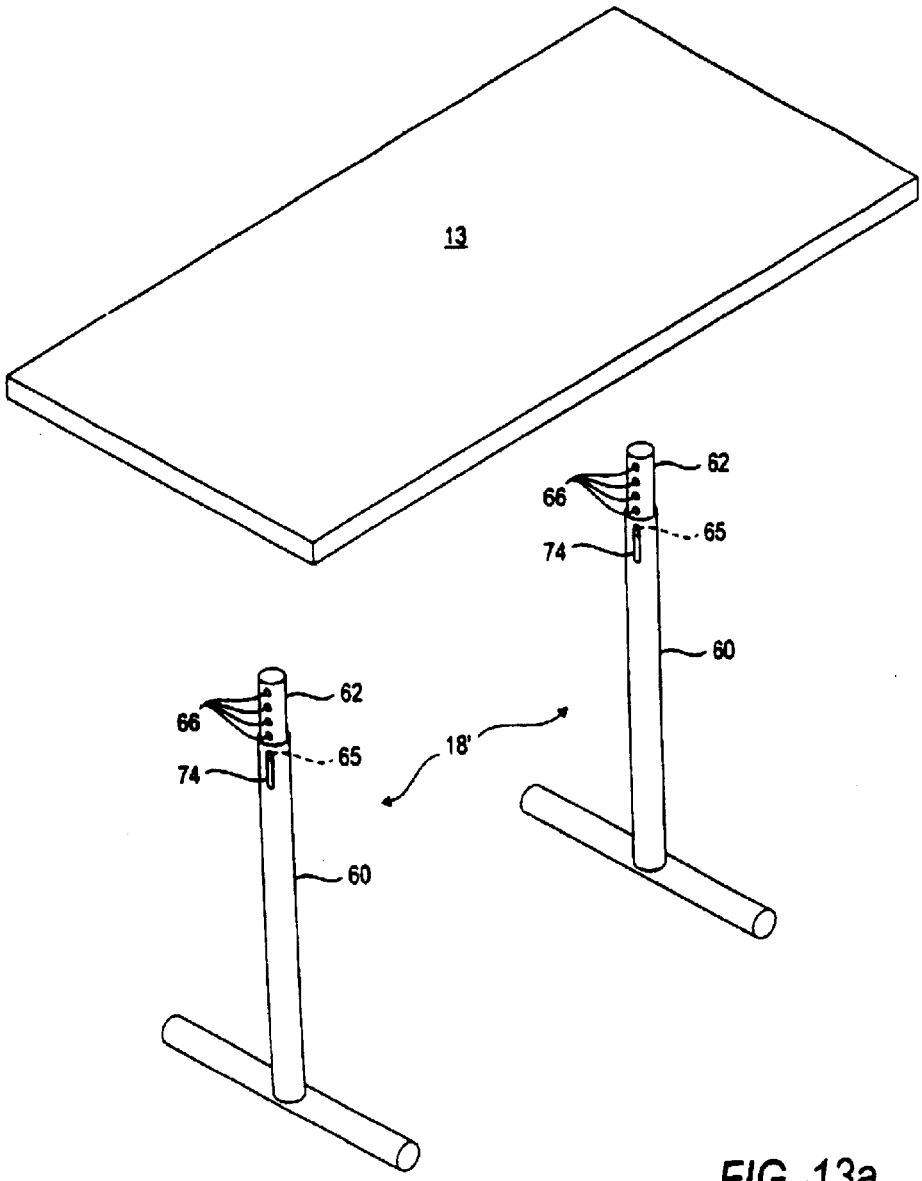
FIG. 13*a* is a perspective view of a pair of adjustable legs and a table for use with the folding table base of FIG. 1.
Figure 13B:
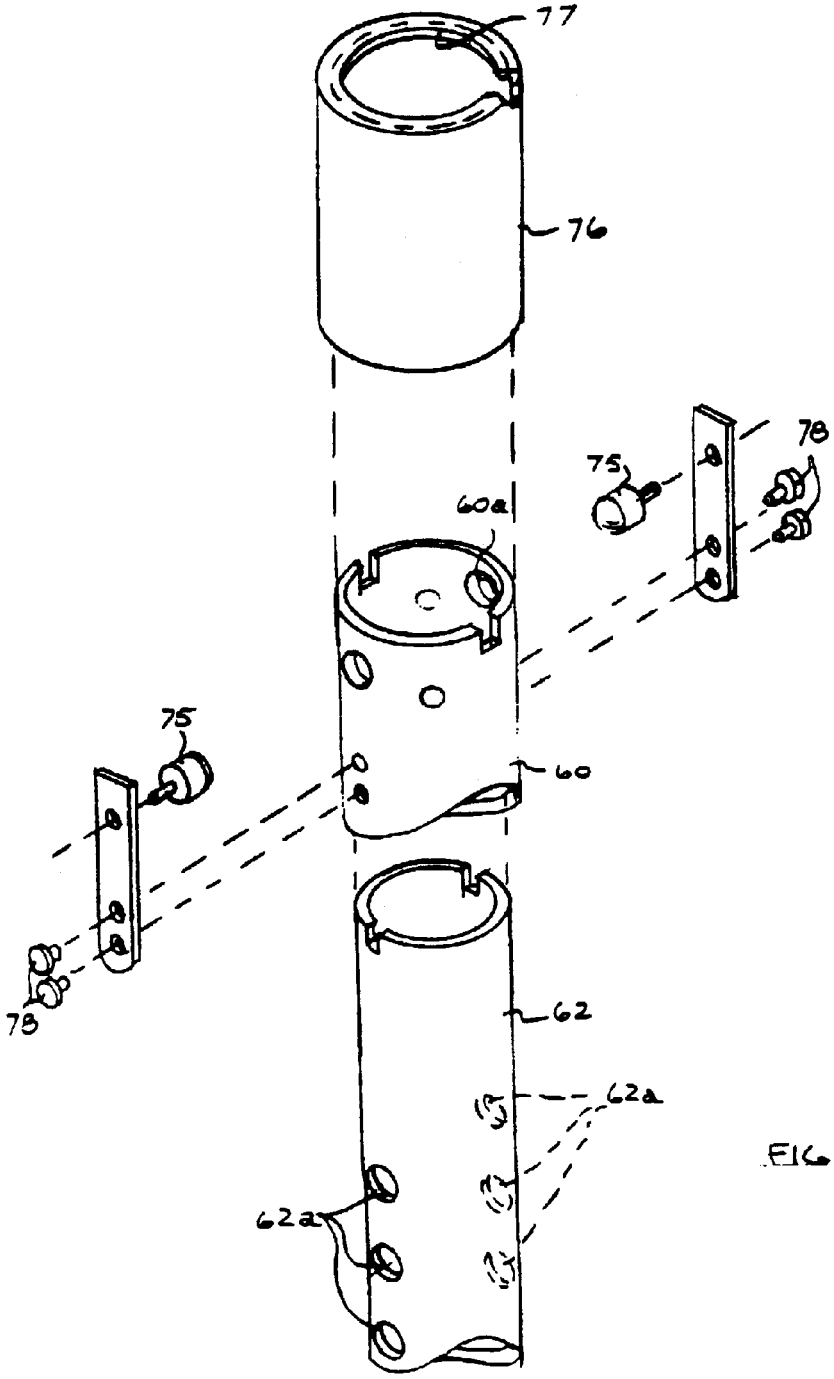
FIG. 13*b* is an exploded perspective view of a portion of an adjustable leg and locking device for use with the folding table base of FIG. 1.

In another embodiment of the invention, the leg 18' is secured in place by a spring tab 74, as illustrated in FIG. 13*a*. The lower end of each spring tab 74 is secured to the outer surface of the lower leg section 60 by welding, fastening, etc. The upper end of each tab 74 carries a pin 75 that is just long enough to pass through a pair of registered holes 60*a* and 62*a* in the lower and upper leg sections 60 and 62, thereby locking the two sections together at the desired height. To hold the locking pin 75 in place, a short sleeve 76 is telescoped over both tabs 74 so as to hold the upper ends of the tabs against the surface of the lower leg section 60, as illustrated in FIG. 13*b*. An inside flange 77 on the upper end of the sleeve 76 abuts the upper end of the lower leg section 60 to limit the downward movement of the sleeve 76 so that it remains in place over the locking tabs 74, as can be seen in FIG. 13*b*.

Figures 13C, 13D, 13E:
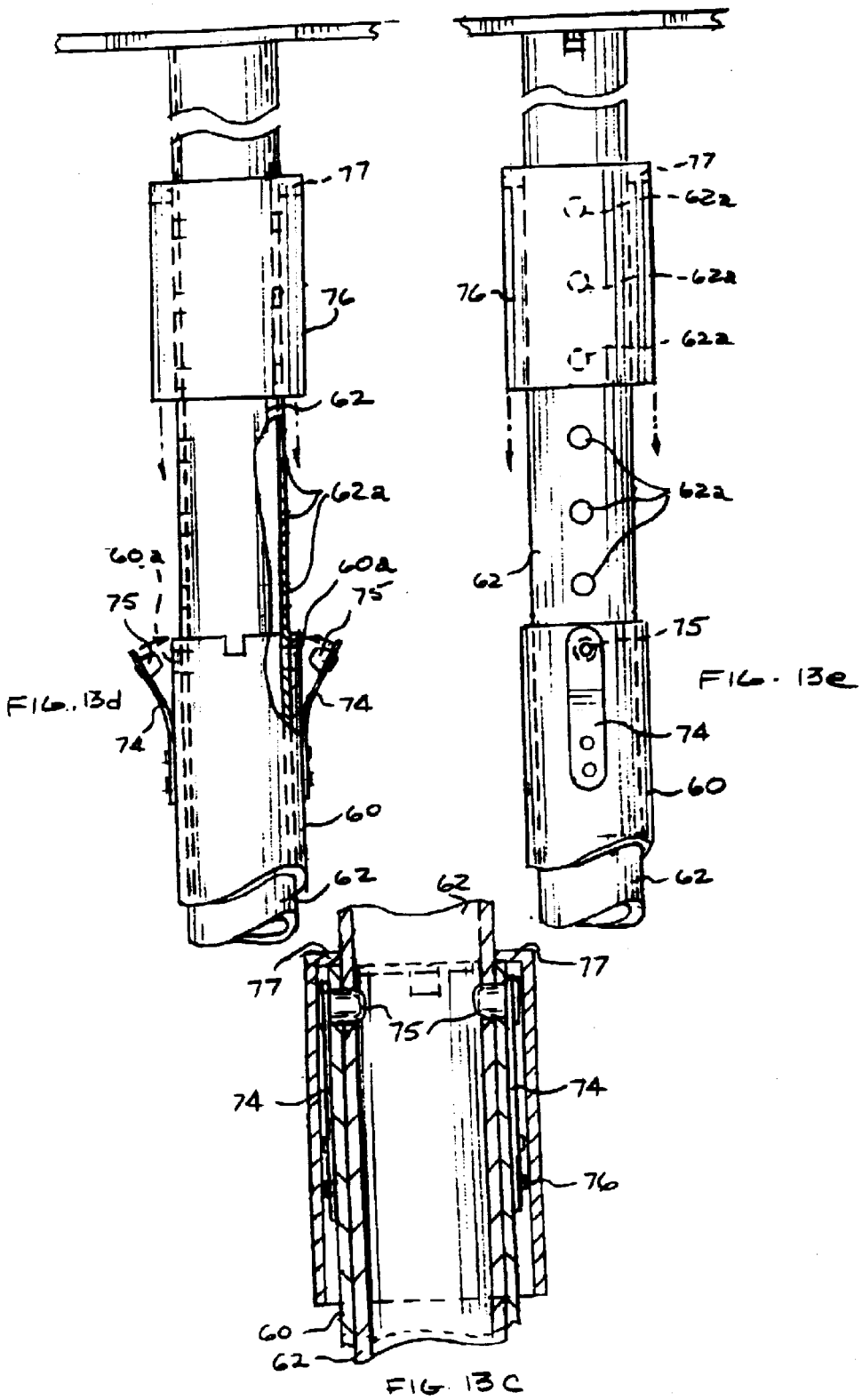
FIG. 13*c* is an enlarged vertical section of the leg shown in FIG. 13*b* with the parts assembled and with the two sections of the leg locked together.
FIG. 13*d* a side elevation of the leg shown in FIGS. 13*b* and 13*c* with the parts assembled and with the two sections of the leg unlocked.
FIG. 13*e* is the same side elevation shown in FIG. 13*d* rotated 90 degrees around the axis of the leg.

When it is desired to unlock the two leg sections, the sleeve 76 is manually moved upwardly along the upper leg section 62 to clear the tabs 74, as illustrated in FIGS. 13*c* and 13*d*. This permits the free ends of the tabs 74 to be pulled outwardly away from the surface of the section 60, as illustrated in FIG. 13*b*, to remove the pins 75 from the holes in both leg sections 60 and 62. The length of the leg can then be adjusted as desired and then again locked by the spring action of the tabs 74. In the particular example illustrated in FIGS. 13*a*–13*d*, the upper leg section 62 is provided with six different holes 62*a*, but it will be appreciated that any desired number of holes may be provided, and at any desired spacing within the range of telescoping overlap between the two leg sections 60 and 62.

In the illustrative embodiment, each locking tab 74 is attached to the leg section 60 by a pair of rivets 78, but of course other fastening devices or techniques, such as welding, may be employed if desired. The locking pins 75 are attached to the tabs 74 by staking pins formed as integral parts of the tabs, but here again alternative fastening means such as welding may be employed if desired.

The spring tab 74 is bent at its tip, as illustrated in FIG. 13*b*, such that when one pair of holes 60*a* and 62*a* are aligned, the tip of spring tab 74 will protrude into the holes 60*a* and 62*a* thus locking the first and second section 60 and 62 in place.

In a further embodiment (not shown), another folding table base 10 is secured to the bottom of the table. In this way, the table has two folding table bases 10 disposed on respective ends of the table for easily folding legs 18 from a closed position to an open position where the legs 18 are stably locked. After use of the table, the legs 18 can be easily folded to a closed position which facilitates easy storage of the table.

Figure 14:
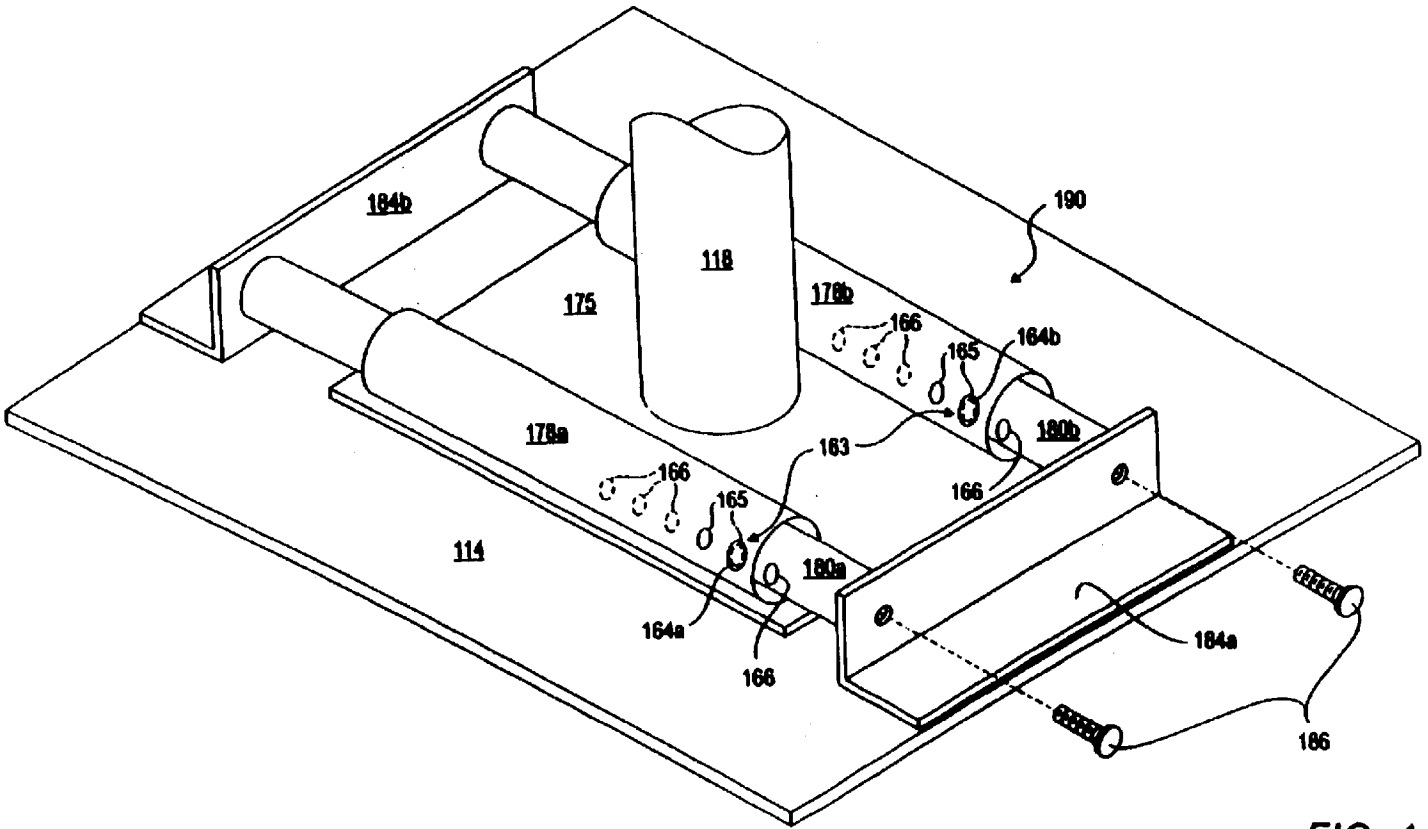
FIG. 14 is a perspective view of a hinge plate for use with the folding table base of FIG. 15 to allow lateral adjustment of the legs of the table.
Figure 15:
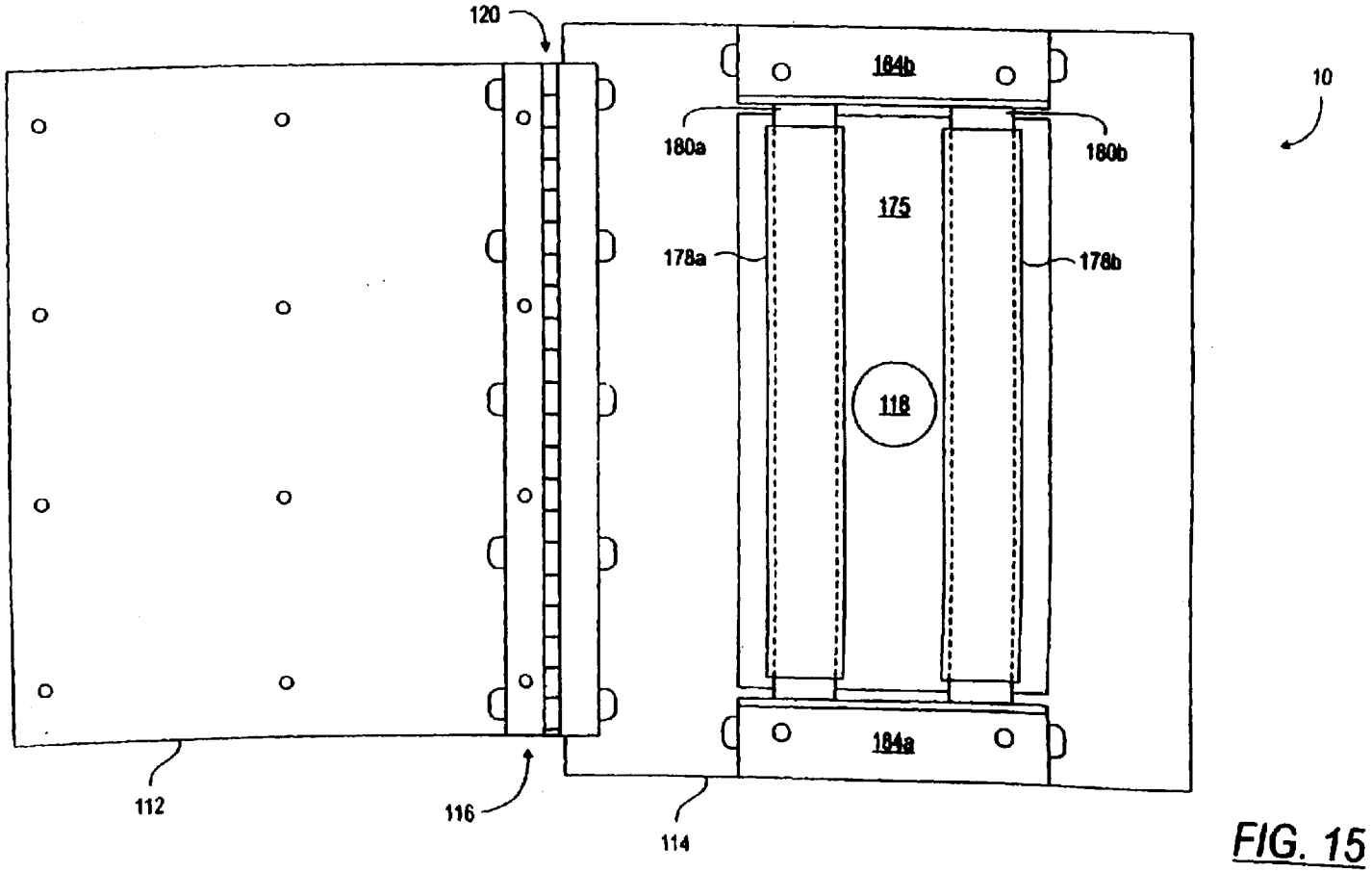
FIG. 15 is a top view of a folding table base including the hinge plate of FIG. 14.

FIGS. 14–15 illustrate another embodiment where the folding table base 10 includes a leg sliding mechanism 190 mechanically secured to the bottom of a table. In one aspect of this embodiment, the leg sliding mechanism 190 is mechanically secured to the bottom of the table by fasteners. In another aspect of this embodiment, the leg sliding mechanism 190 is mechanically secured to the bottom of the table by being secured to a hinge plate 114 that is pivotally connected to a side 116 of a mounting plate 112 by a hinge 120. The hinge 120 is secured to the mounting plate 112 by welding, riveting, fastening, etc. The mounting plate 12 is secured to the bottom of the table by fasteners such as nails, screws, bolts, etc. The hinge plate 114 is adapted to pivot between a first position and a second position, as detailed above with respect to hinge plate 14. The leg sliding mechanism 190 includes a leg 118 extending generally orthogonal thereto. The leg sliding mechanism 190 is adapted to slide between a first position and a second position such that the leg 118 is laterally adjustable with respect to the table. A locking mechanism 163 secures the leg sliding mechanism in a particular position.

Figure 16A:
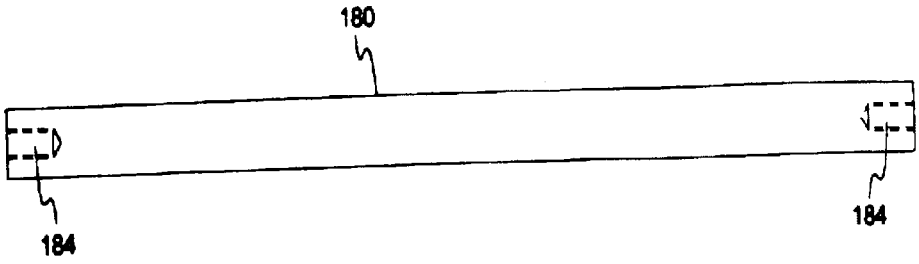
FIG. 16*a* is a side view of a rod for use with the hinge plate of FIGS. 14 and 15.

In still another aspect of this embodiment, the leg 118 is secured to a leg plate 175 and extends generally orthogonal thereto. The leg 118 is secured to the leg plate 175 by, for example, welding. The leg plate 175 is secured to a pair of hollow pipes 178*a* and 178*b* by, for example, welding. A pair of rods 180*a* and 180*b* are disposed in the hollow pipes 178*a* and 178*b*, respectively. The hollow pipes 178*a,b* slide back and forth on the rods 180*a,b* so the leg 118 can be adjusted laterally (front to back with respect to the table). This allows the legs 118 to be moved laterally away from where a person sits so the legs 118 do not hit the person's legs. The rods 180*a,b* are secured between angle mounts 184*a* and 184*b* fasteners 186. The rods 180*a,b* are identical in construction, as illustrated in FIG. 16, and include fastener receptacles 184.

In a further aspect of this embodiment, the locking mechanism 163 comprises a pair of pins 164*a,b*. In this aspect, the hollow pipes 178*a,b* each have a plurality of holes 165 disposed therethrough. The rods 180*a,b* each have a plurality of holes 166 disposed therethrough. The hollow pipes 178*a,b* are secured in a particular position by inserting the pins 164*a,b* through one pair of aligned holes 165 and 166. Alternatively, the locking mechanism 163 comprises a pair of spring tabs (not shown) that operate essentially as described above in relation to spring tab 74.

Figure 16B:
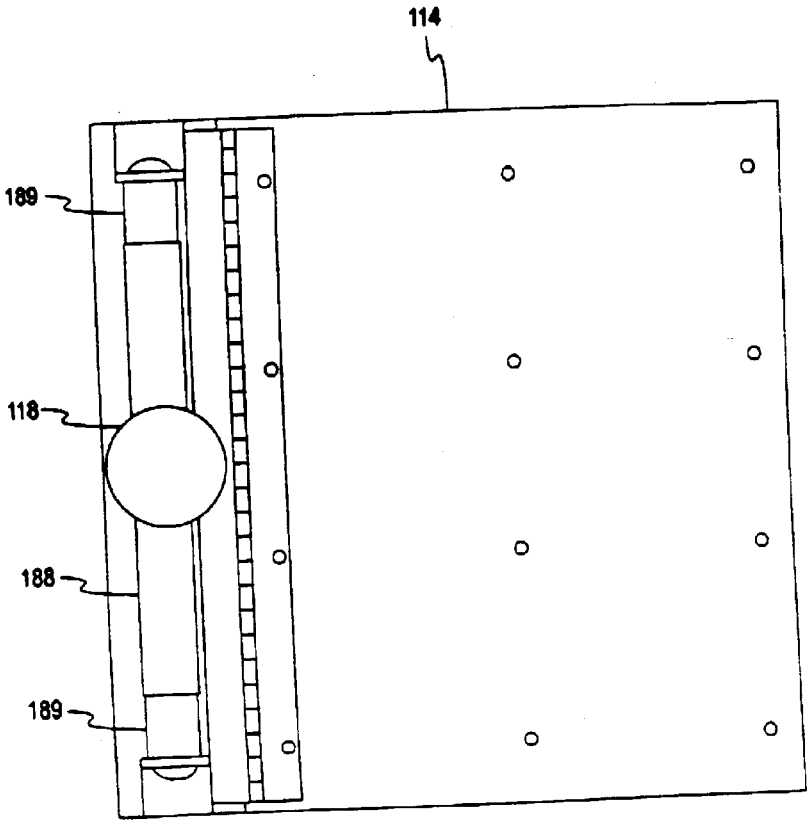
FIG. 16*b* is a bottom plan view of a modified hinge plate to allow lateral adjustment of the legs of the table.

FIG. 16*b* illustrates a modified design in which the leg 118 is attached to a single outer tube 188 that telescopes over a single inner tube 189 attached to the hinge plate 114. In this embodiment the lateral position of the leg 118 is adjusted by simply sliding the tube 188 along the tube 189 to the desired position, and then locking the two tubes together in that position by use of the same type of locking mechanism 163 described above.

In another aspect of this embodiment, the legs 118 each include a foot like the foot 70 illustrated in FIG. 5. In a further aspect of this embodiment, the legs 118 are each adjustable, like the leg 18' illustrated in FIGS. 3 and 6.

Figure 17B:
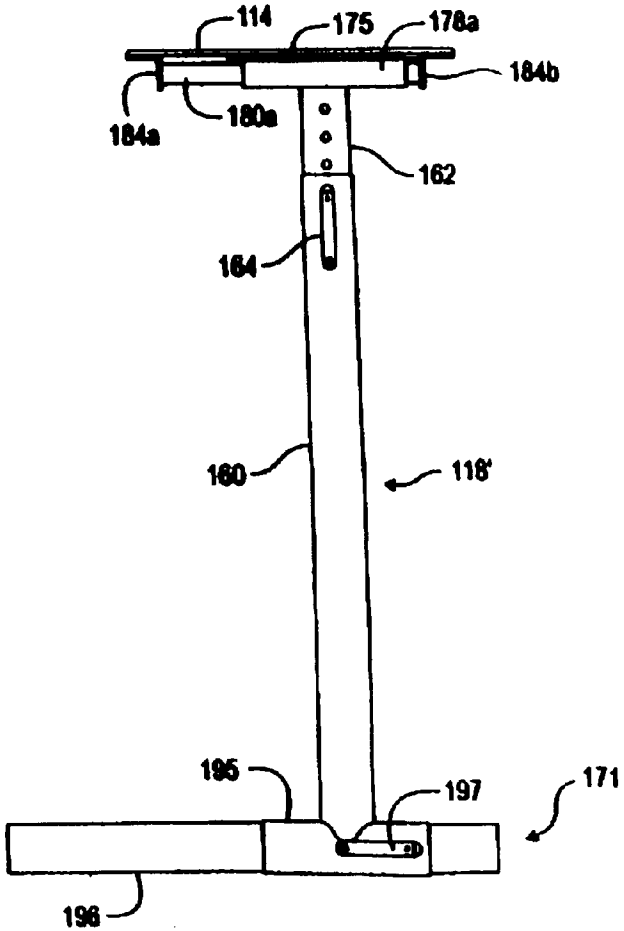
FIG. 17*b* is a side view of the vertically and laterally adjustable leg of FIG. 17*a* in a second position.
Figure 17A:
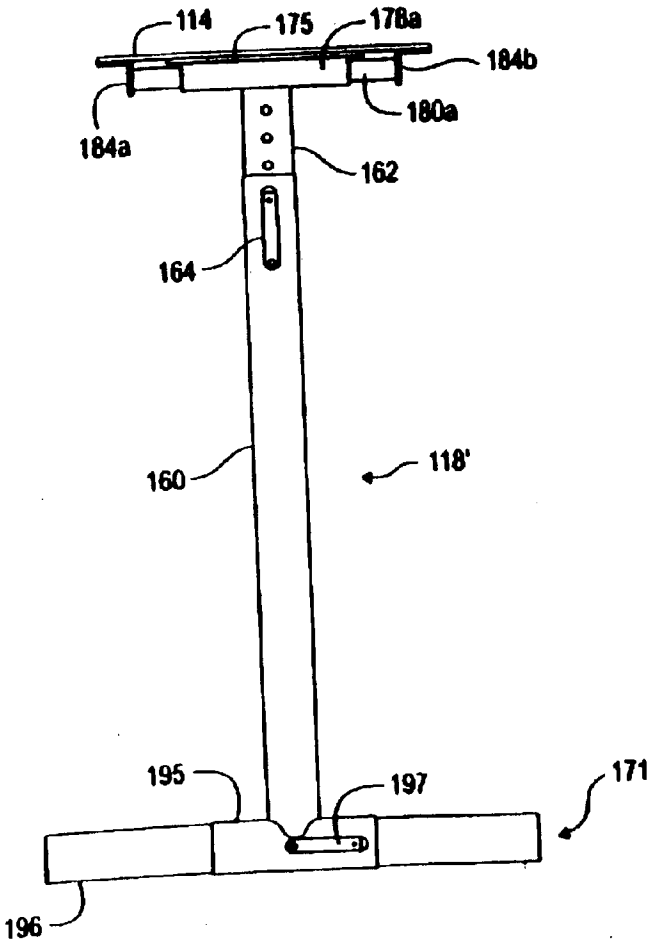
FIG. 17*a* is a side view of a vertically and laterally adjustable leg in a first position.
Figure 18:
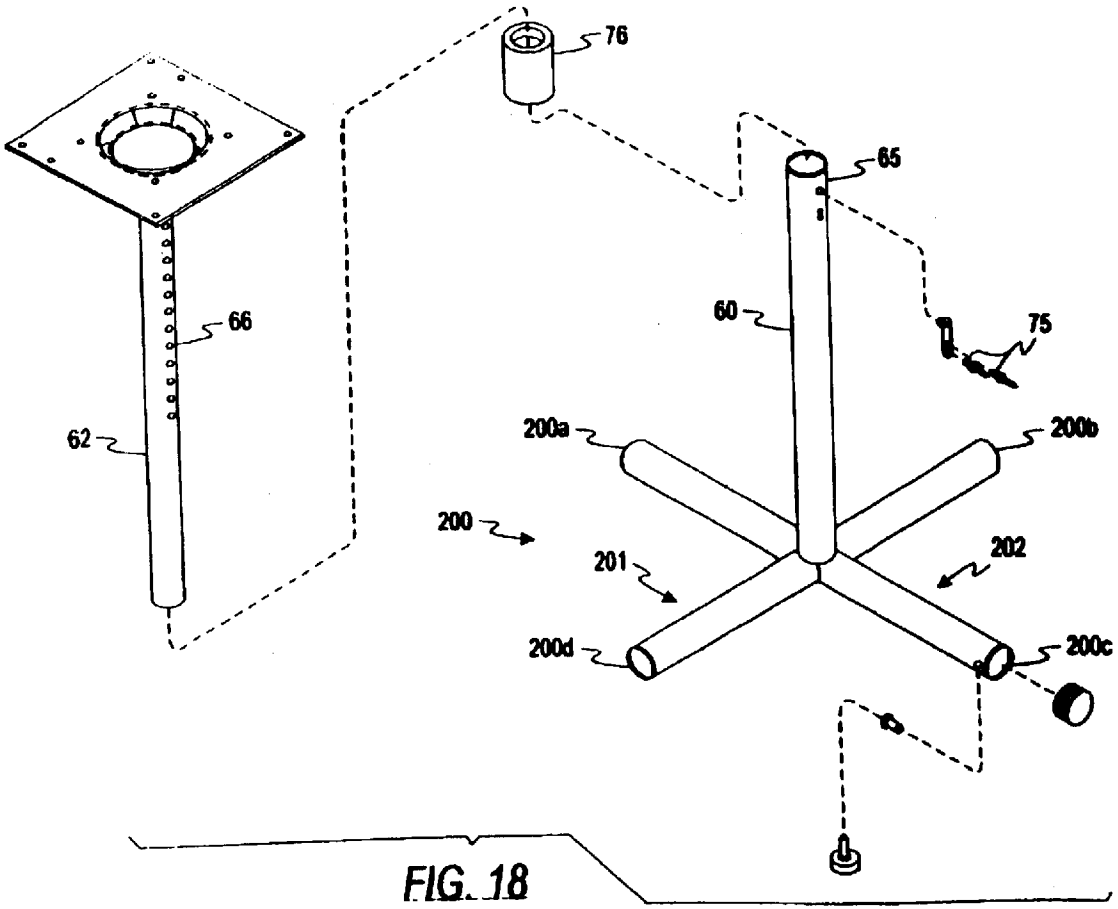
FIG. 18 is an exploded perspective view of a modified leg and base structure for use in the folding table base of FIG. 1.

In still another aspect of this embodiment illustrated in FIGS. 17*a* and 17*b*, the vertically adjustable legs 118' each include a laterally adjustable foot 171. The laterally adjustable foot 171 includes a foot sleeve 195, a foot tube 196 and a foot lock 197. The foot sleeve 195 slides back and forth on the foot tube 196. The foot sleeve 195 is locked in a particular position on the foot tube 196 by the foot lock 197. In one aspect, the foot lock 197 comprises a spring tab that operates essentially as described above in relation to spring tab 74. In another aspect, the foot lock 197 comprises a pin (not shown) that operates essentially as described above in relation to pin 64. Therefore, when the legs 118' are moved laterally away from the user, the stability of the table is maintained by moving each leg tube 196 laterally toward the user, and vice versa.

With the exception of the lateral movement of the leg 118, the operation of the hinge plate 114 is the same as the hinge plate 14 described above. Therefore, a detailed description of how the latching mechanism interacts with the hinge plate 114, etc. has been omitted.

Figure 20:
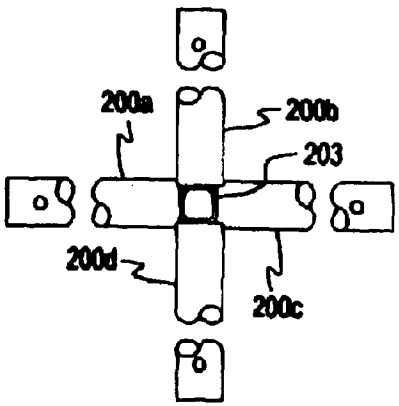
FIG. 20 is a bottom plan view of the central portion of the base structure shown in FIG. 19.
Figure 19:
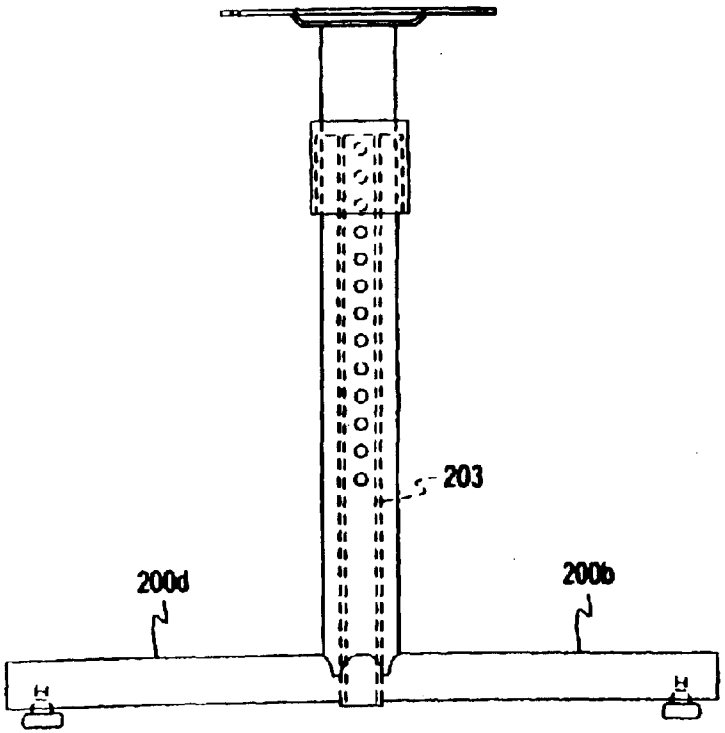
FIG. 19 is a side elevation of the modified leg and base structure of FIG. 18 with all the parts assembled.
Figure 21:
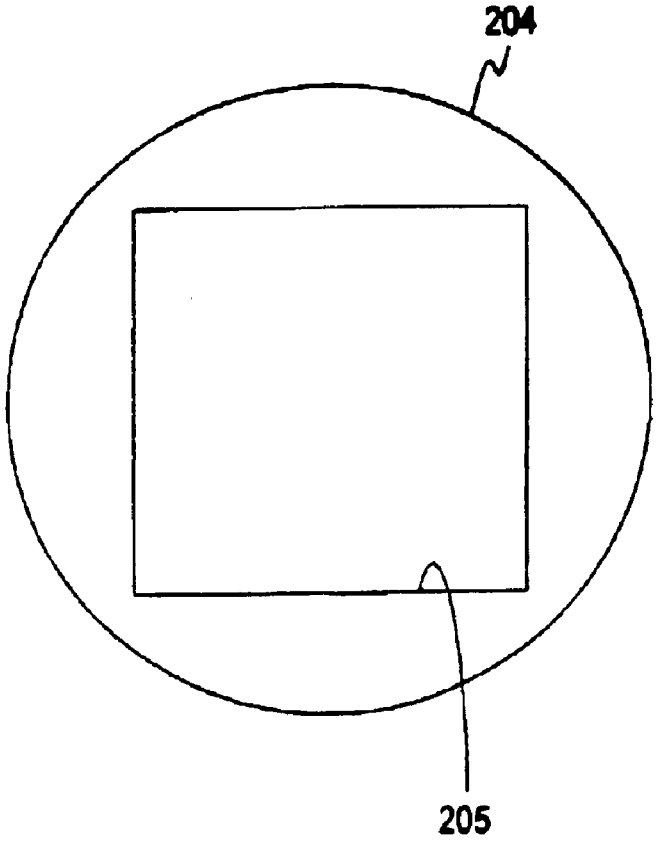
FIG. 21 is a plan view of an apertured plate mounted in the lower interior of the upper telescoping tube.

FIGS. 18–21 illustrate a modified leg and base structure in which the foot 200 comprises four tubular elements 200*a*,

200*b* 200*c* and 200*d* welded together to form a pair of orthogonal members 201 and 202 that provide more stable support for the table. In addition, as can be seen in FIGS. 19 and 20, a square tube 203 extends upwardly from the foot 200 through the interior of the lower telescoping tubular section 60 to assist in registering the holes in the telescoping tubular sections 60 and 62. The relationship between the square tube 203 and the lower tubular section 60 is fixed because they are both welded to the same foot structure. To align the holes in the upper tubular section with the holes in the lower section 60, a plate 204 (see FIG. 21) having a square aperture 205 only slightly larger than the outside dimensions of the tube 203 is mounted in the lower portion of the interior of the upper tubular section 62. Thus, when the upper section 62 is telescoped down into the lower section 60, the upper section 62 can be rotated slightly until the aperture 205 in the plate 204 registers with the square tube 203, and then the telescoping movement can be continued with the plate 204 riding downwardly over the outer surface of the square tube 203. The plate 204 and the tube 203 thus hold the two tubular sections 60 and 62 in a fixed azimuthal relationship to each other, so that the holes in the two sections 60 and 62 are aligned with each other for smoothly receiving the locking pins 75 when the sleeve 76 presses the pins 75 radially inwardly.

While the invention has been described above with specific reference to various embodiments utilizing legs that have a circular cross-sectional configuration, it will be understood that other cross-sectional configurations, such as square, rectangular, oval, octagonal, etc., may be employed without departing from the invention.

Other aspects, features, advantages and modifications of the present invention will become apparent to those skilled in the art upon studying this invention. All such aspects, features, advantages and modifications of the present invention are intended to be within the scope of the present invention as defined by the appended claims.

What is claimed is:

1. A table having a table top and at least one laterally adjustable leg and foot to permit the conversion of the table configuration, comprising:

first adjustment means at the upper end of said leg for connecting said leg to said table top while permitting adjustment of the lateral position of said leg relative to said table top, said first adjustment means including means for holding said leg in a selected lateral position relative to said table top, and second adjustment means at the lower end of said leg for connecting said leg to said foot while permitting adjustment of the lateral position of said foot relative to said leg, said second adjustment means including means including means for holding said foot in a selected lateral position relative to said leg, wherein each of said first and second adjustment means includes an outer member carrying at least one tab having a movable end and a fixed end, said fixed end being connected to the outer surface of said outer member proximate one end thereof, said movable end having means for protruding inwardly through said member; and an inner member having an end portion telescoped within said outer member, said inner member having at least one aperture for receiving said protruding means when it protrudes inwardly through said outer member.

2. The table of claim 1 wherein said outer and inner members are tubular members.

3. The table of claim 1 wherein said outer member has a transverse aperture extending through at least one side thereof proximate the upper end thereof, said protruding means on said tab is adapted to extend inwardly through said aperture, and said inner member has a plurality of transverse apertures for receiving said protruding means when it protrudes through said transverse aperture in said outer member.

4. The table of claim 1 wherein said tab is a spring tab.

5. The table of claim 1 wherein said protruding means comprises a pin.

6. A method of laterally adjusting the position of at least one leg of a table, said method comprising:

providing said leg with a lateral adjustment mechanism, said mechanism connecting said leg to said table, said mechanism including at least one pair of telescoping inner and outer tubular members having transverse apertures extending therethrough, said inner member having a plurality of said apertures spaced along a portion of the length thereof, and said outer member having a spring tab mounted on the outer surface thereof, said spring tab having a fixed end being connected to the outer surface of said outer member and a movable end having means for protruding inwardly through said transverse apertures; and moving said inner member relative to said outer member to adjust the lateral position of said table and to register one of said plurality of apertures in said inner member with said aperture in said outer member.

7. The method of claim 6 which includes telescoping a sleeve over said spring tab to hold said protruding means in place within said transverse apertures of said inner and outer tubular members.

8. The method of claim 7 wherein the relative movement between said sleeve and said outer member is limited by engaging said outer member with a flange on one end of said sleeve.

9. The method of claim 8 wherein said flange extends inwardly from the upper end of said sleeve.

10. A method of converting the configuration of a table having a table top and at least one laterally adjustable leg and foot between a T configuration and an L configuration, comprising:

adjusting the lateral position of said leg relative to said table top via a leg lateral adjustment mechanism by moving the upper end of said leg to a selected lateral position relative to said table top and then holding said leg in said selected lateral position, and adjusting the lateral position of said foot relative to said leg by moving said foot to a selected lateral position relative to said leg via a foot lateral adjustment mechanism and then holding said foot in said selected lateral position, said foot being secured to a lower end portion of said leg.

11. A table base comprising:

a leg sliding mechanism mechanically secured to the bottom of a table, said leg sliding mechanism including a leg plate, a leg extending generally orthogonal thereto, said leg sliding mechanism being adapted to slide between a first position and a second position such that said leg is laterally adjustable with respect to the table, said leg being secured to said leg plate and extending generally orthogonal thereto, a pair of angle mounts secured to the bottom of said table, and a pair of hollow pipes and a pair of rods, said pair of rods being respectively disposed in said pair of hollow pipes and secured between said pair of angle mounts, said pair of hollow pipes being secured to said leg plate such that said pair of hollow pipes are generally parallel with respect to each other, said pair of hollow pipes adapted to slide back and forth on said pair of rods; and a locking mechanism for securing said leg sliding mechanism in a particular position.

12. The folding table base of claim 11, wherein said pair of rods are identical in construction.

13. The folding table base of claim 11, wherein said pair of hollow pipes and said pair of rods are secured in a particular position by a pin.

14. The folding table base of claim 11, wherein said pair of hollow pipes and said pair of rods are secured in a particular position by a spring tab.

15. A table base comprising:

a leg sliding mechanism mechanically secured to the bottom of a table, said leg sliding mechanism including a leg extending generally orthogonal thereto, said leg sliding mechanism being adapted to slide between a first position and a second position such that said leg is laterally adjustable with respect to the table;

a mounting plate adapted to be secured to the bottom of a table, said mounting plate having a side;

a hinge plate hingedly connected to said side of said mounting plate, said hinge plate being adapted to pivot between an open position and a closed position; and a latching mechanism secured to the bottom of said table, said latching mechanism including a pull latch that engages said hinge plate when said pull latch is in a latched position and disengage said hinge plate when said pull latch is in an unlatched position, wherein said latching mechanism includes a latch mounting plate, said pull latch being slidably mounted on said latch mounting plate such that said pull latch is operable between said latched position and said unlatched position, said latching mechanism engaging said hinge plate at two displaced locations when said pull latch is in said latched position.

* * * * *